US006477728B1

(12) United States Patent
Faz

(10) Patent No.: US 6,477,728 B1
(45) Date of Patent: Nov. 12, 2002

(54) PATIENT TRANSPORT DEVICE

(76) Inventor: Ray J. Faz, 2228 Riverview Dr., Grand Island, NE (US) 68801

( * ) Notice: Subject to any disclaimer, the term of this patent is extended or adjusted under 35 U.S.C. 154(b) by 0 days.

(21) Appl. No.: 09/847,635

(22) Filed: May 2, 2001

(51) Int. Cl.[7] ..... A61G 1/017

(52) U.S. Cl. ..... 5/625; 5/627; 5/634; 128/870; 297/380

(58) Field of Search ..... 5/625, 627, 633, 5/634, 656, 657; 128/870; 297/380

(56) References Cited

U.S. PATENT DOCUMENTS

| | | | | | |
|---|---|---|---|---|---|
| 455,778 | A | * | 7/1891 | Tell | 280/8 |
| 618,274 | A | * | 1/1899 | Jones | 5/627 |
| 675,409 | A | * | 6/1901 | Pettee | 5/627 |
| 1,849,864 | A | * | 3/1932 | Caspar | 224/157 |
| 4,824,171 | A | * | 4/1989 | Hollingsworth | 297/351 |
| 5,384,923 | A | * | 1/1995 | Hwang et al. | 297/380 |
| 5,515,549 | A | * | 5/1996 | Wang | 297/183.6 |
| 5,720,303 | A | * | 2/1998 | Richardson | 128/870 |

FOREIGN PATENT DOCUMENTS

| | | | | |
|---|---|---|---|---|
| WO | WO 89/07430 | * | 8/1989 | 5/625 |

OTHER PUBLICATIONS

"Dynamed Cat 1048" catalog, Fall 1999, pp. 10, 13, 18–20, 22, 28–29, 36, 44–45.

* cited by examiner

*Primary Examiner*—Michael F. Trettel
(74) *Attorney, Agent, or Firm*—Thomte, Mazour & Niebergall; Dennis L. Thomte

(57) ABSTRACT

A patient transport device is disclosed which includes a seat member, a back member, a leg supporting member, and a head supporting member. The device may be unfolded to a position wherein the patient may be transferred thereon in a supine position. The back member may be selectively adjustably positioned with respect to the seat member so that the patient may be transferred thereon in a sitting position with either the patient's legs hanging downwardly from the seat member or extending outwardly therefrom in a horizontal position. Various carrying straps are provided on the device to enable the patient to be easily transported in either the supine position or in a seated position. Restraining straps are also provided.

9 Claims, 7 Drawing Sheets

PATIENT TRANSPORT DEVICE

BACKGROUND OF THE INVENTION

1. Field of the Invention

This invention relates to a patient transport device and more particularly to a patient transport device which is capable of transporting a patient in either a sifting position or a supine position. In the sitting position, the patient's legs may either hang downwardly or be extended horizontally outwardly from the seat member of the device.

2. Description of the Related Art

Many types of patient transport devices have been provided to enable paramedics or the like to move or transport a patient from a patient's home or accident scene to an ambulance and then transport the patient from the ambulance into the hospital. If the patient is to be transported in a supine position, a stretcher or spine board is normally utilized. One disadvantage in using a stretcher is that the patient must normally be lifted onto the stretcher which can be a painful experience for the patient due to the fact that the patient must be grasped beneath the shoulders, legs, etc., to manually lift the patient onto the stretcher. Although it is somewhat easier to place the patient on a spine board than on a stretcher, the spine board is somewhat difficult to grasp and carry. Both stretchers and spine boards suffer from the further disadvantage in that they are difficult to maneuver in close quarters, around corners, etc. In some cases, the patient cannot be transported in a supine position due to patient infirmities or injuries or the patient's location is such that a stretcher or spine board cannot be used. In those cases, the patient is sometimes strapped into a conventional chair which requires that the patient be manually lifted into the chair. Further, when a chair is used to transport the patient, the chair is difficult to grasp and carry. Additionally, in some cases where the patient is to be transported in a chair, there is no convenient method whereby the patient's legs can be extended outwardly form the chair in a horizontal position.

SUMMARY OF THE INVENTION

A patient transport device is disclosed which enables a patient to be transported in a supine position or a sifting position with the patient's legs either hanging downwardly therefrom or extending outwardly therefrom in a horizontal position. The device is extremely portable in that it can be folded together and easily placed into a carrying bag.

The device generally consists of a seat member, a back member, a leg supporting member, and a head supporting member. The back member is hingedly secured to the rear end of the seat member and may be folded forwardly onto the seat member for storage. The back member may be folded to a horizontal position to enable the patient to be transported in a supine position or folded to an upright position, or any position therebetween. Length adjustable support straps extend between the sides of the seat member and the sides of the back member to selectively maintain the back member in selected positions with respect to the seat member.

The head supporting member is hingedly secured to the front surface of the back member below the upper end thereof and is movable from a stowed position adjacent the front surface of the back member to an operative head supporting position wherein it extends from the upper end of the seat member to support the head of the patient whether the patient is in a sitting position or in a supine position.

A flexible leg supporting member extends from the forward end of the seat member and is normally stowed beneath the seat member and behind the lower portion of the back member. The leg supporting member may be moved from its stored position to a position wherein it extends outwardly from the forward end of the seat member to support the legs of the patient who is either in a sitting position or a supine position.

Carrying straps are attached to the back member, seat member, and leg supporting member and extend laterally outwardly therefrom. The carrying straps may be stowed in a folded condition when not in use. A plurality of restraining straps are secured to the device to restrain the patient on the device. The back member, seat member, and head supporting member include plastic sheet members enclosed with a compartment to enable the sheet members to be removed from the compartments to enable the device to be cleaned and/or sanitized.

It is therefore a principal object of the invention to provide an improved patient transport device.

A further object of the invention is to provide an improved patient transport device which enables a patient to be transported in either a supine or sitting position.

A further object of the invention is to provide an improved patient transport device which enables the patient to be transported in a sitting position.

Yet another object of the invention is to provide an improved patient transport device which enables the patent to be transported in a sitting position with the patient's legs either hanging downwardly from the seat thereof or extending outwardly therefrom.

A further object of the invention is to provide an improved patient transport device which enables a patient to be transported in either a supine or sitting position which is convenient to use.

A further object of the invention is to provide an improved patient transport device which enables a patient to be transported in either a supine or sitting position which is conveniently stored in a compact fashion.

Yet another object of the invention is to provide an improved patient transport device which enables a patient to be transported in a sitting position with the angle of the back member being selectively adjustable with respect to the seat member of the device.

These and other objects will be apparent to those skilled in the art.

DESCRIPTION OF THE PREFERRED EMBODIMENT

Figure 1:
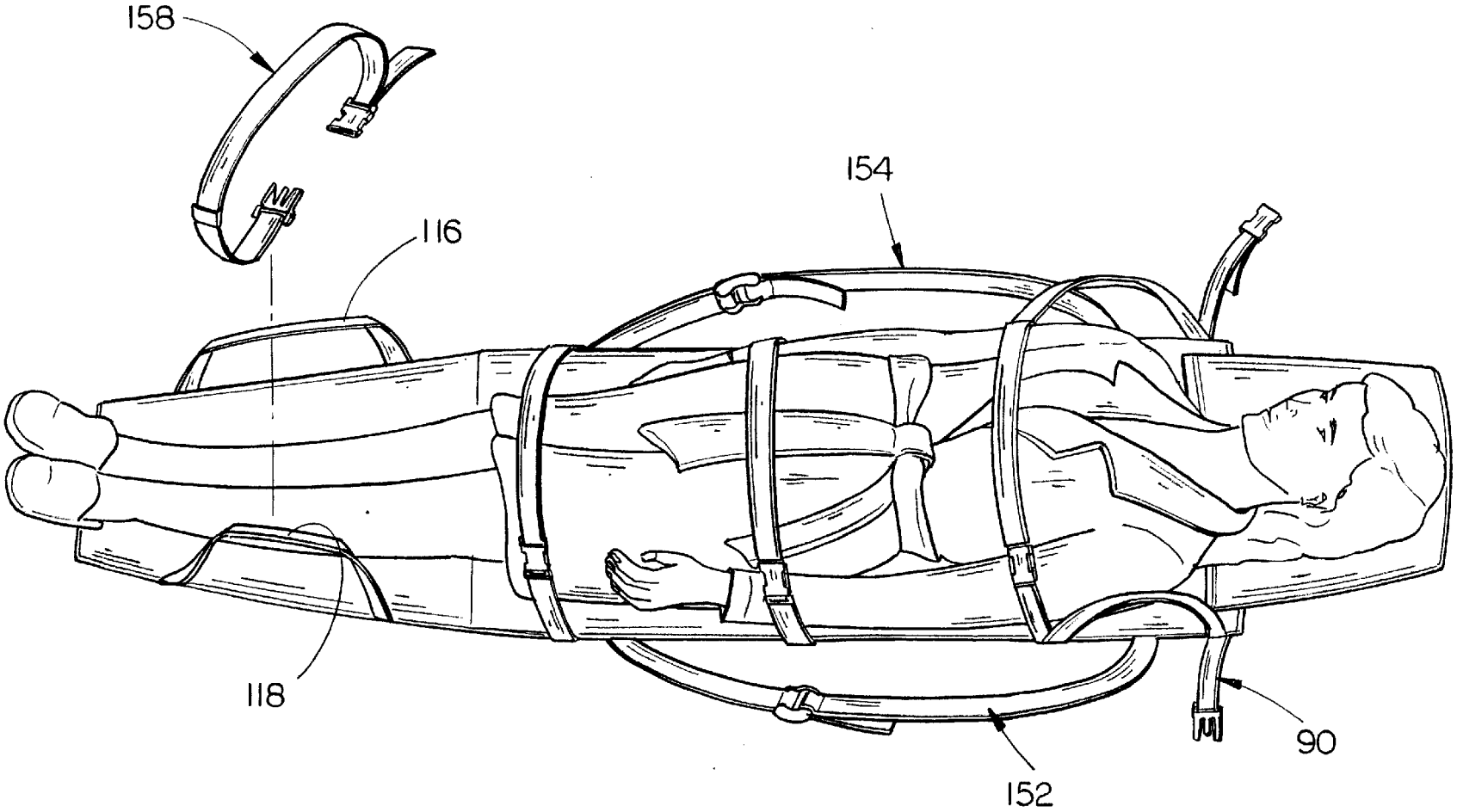
FIG. 1 is a view illustrating a patient positioned on the patient transport device of this invention.

The patient transport device of this invention is generally referred to by the reference numeral 10 and is designed to support a patient in either a sitting position or in a supine position. Further, when the patient is in the sifting position on the device 10, the patient's legs may either hang downwardly from the forward end of the seat portion of the device or may be supported so that the legs of the patient extend straight outwardly from the hips of the patient.

Transport device 10 generally includes a seat member 12, a back member 14, a neck and head supporting member 16, and a leg supporting member 18. For purposes of description, seat member 12 will be described as including a top surface 20, a bottom surface 22, a back end 24, a forward end 26, and opposite sides 28 and 30. Seat member 12 is comprised of a generally rigid plastic sheet member removably enclosed in a sleeve-like cover.

For purposes of description, back member 14 will be described as including a front surface 36, back surface 38, and a lower end 40, an upper end 42, and opposite sides 44 and 46. Back member 14 is comprised of a generally rigid plastic sheet member removably enclosed in a sleeve-like cover. The lower end 40 of back member 14 is hingedly secured to the back end 24 of seat member 12 at 52.

Neck and head supporting member 16 also comprises a generally rigid sheet member removably enclosed in a sleeve-like cover. Neck and supporting member 16 includes a front surface 58, back surface 60, ends 62 and 64, and sides 66 and 68. The end 64 of member 16 is hingedly secured to the front surface 36 of back member 14 at 70 which is below the upper end 42 of back member 14. Member 16 is selectively movable between the stowed position of FIG. 3 to the operative position of FIG. 2. When the member 16 is in its stowed position of FIG. 3, the front surface 58 thereof is positioned adjacent the front surface 36 of member 16.

Figure 6:
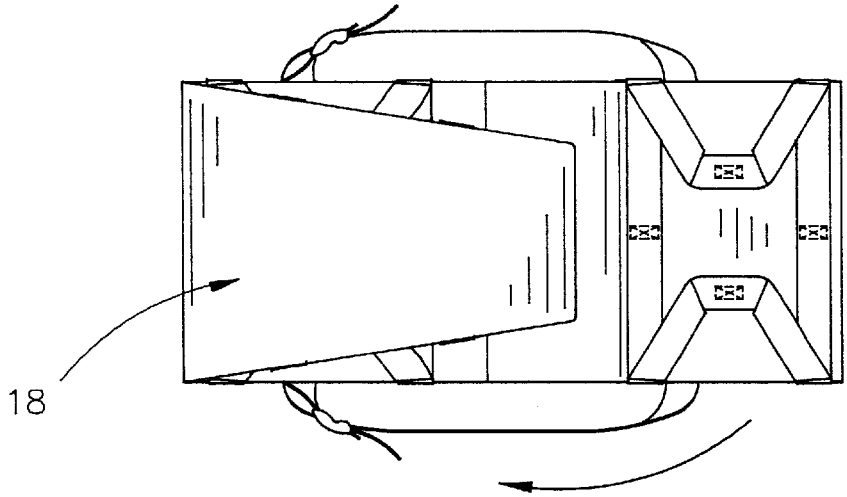
FIG. 6 is a view similar to FIG. 5 except that FIG. 6 illustrates the device being folded.

Leg supporting member 18 is comprised of a flexible sheet member having a top surface 72, a bottom surface 74, ends 76 and 78, and sides 80 and 82. End 76 of member 18 is hingedly connected to the forward end 26 of seat member 12 at 84. Leg supporting member 18 is selectively movable between the stowed position illustrated in FIGS. 6 and 9 to the operative position of FIGS. 1–4. When in its stowed position, the bottom surface of member 18 is positioned adjacent the bottom surface 22 of seat member 12. The free end of supporting member 18, when in the stowed position, is positioned adjacent the lower end of back member 12 at the lower back surface thereof, as seen in FIG. 6.

Figure 5:
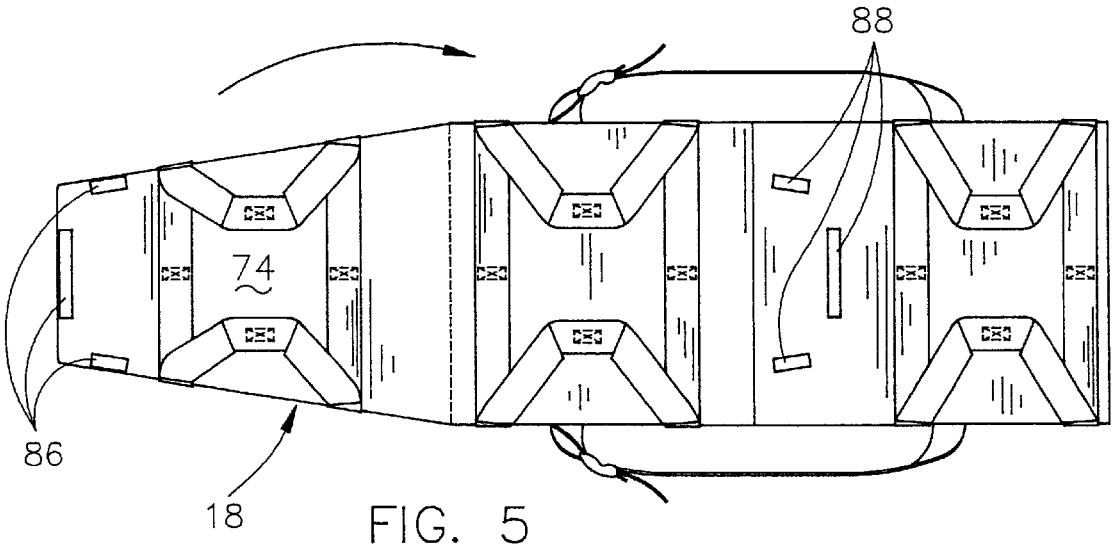
FIG. 5 is a back view of the device.

The hooked portion 86 of a conventional hook-and-loop fastener such as Velcro™ or the like is secured to the bottom surface 74 of leg supporting member 18 adjacent the free end thereof which is adapted to engage the looped portion 88 of a hook-and-loop fastener secured to the lower end of back member 12 at the back surface thereof to selectively maintain the leg supporting member 18 in its stowed position (FIG. 5).

Figure 2:
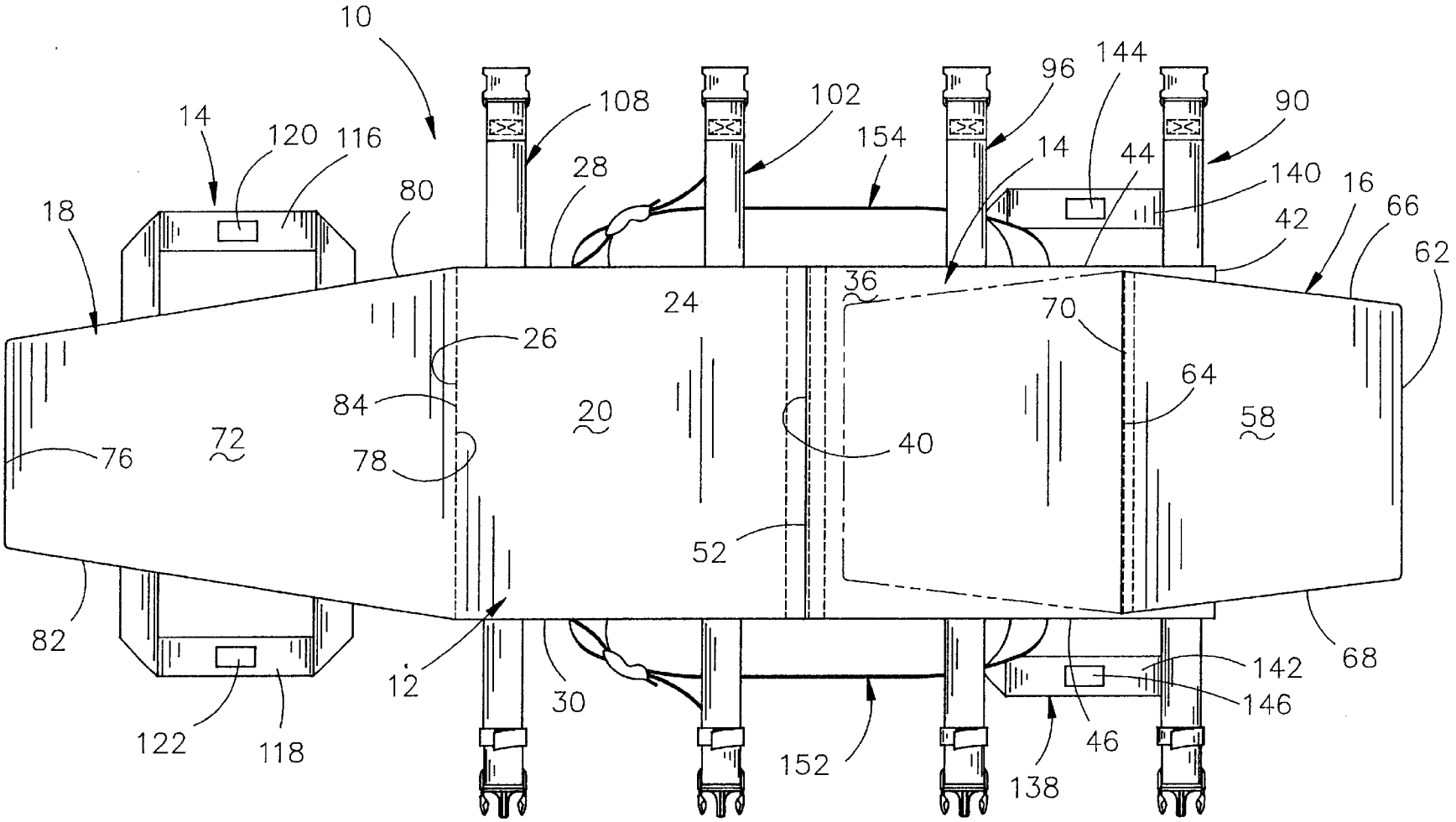
FIG. 2 is a top view of the device in a position designed for supporting a patient thereon in a supine position.
Figure 3:
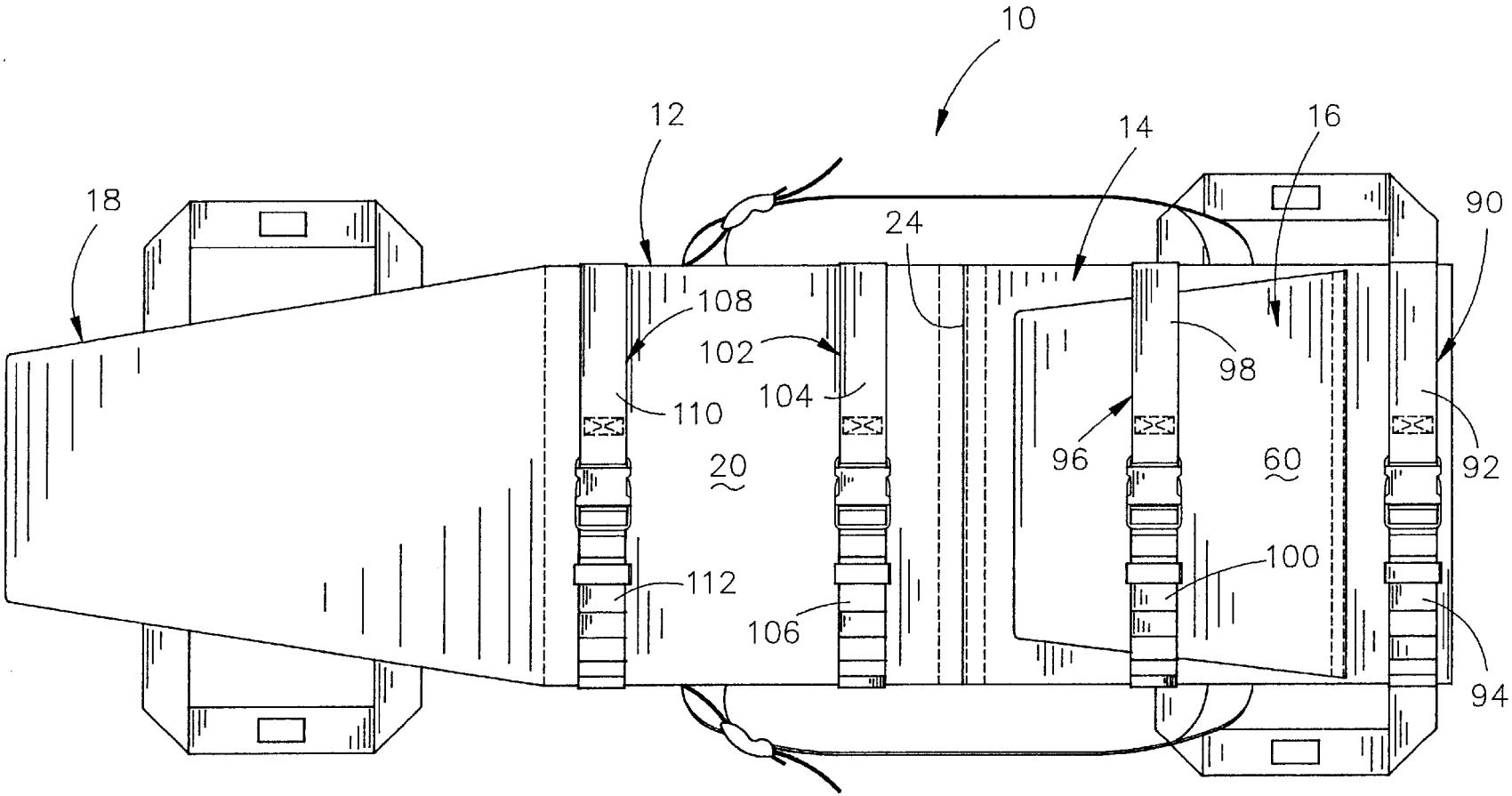
FIG. 3 is a plan view of the device with the head supporting position in its inoperative stowed position.

A selectively connectable restraining strap assembly 90 comprised of straps 92 and 94 is secured to back member 14 adjacent the upper end thereof, as seen in FIGS. 2 and 3. A selectively connectable restraining strap assembly 96 comprised of straps 98 and 100 is secured to back member 14 adjacent the lower end thereof, as seen in FIG. 3. A selectively connectable restraining strap assembly 102 comprised of straps 104 and 106 is secured to seat member 12 adjacent the back end 24, as seen in FIG. 3. A selectively connectable restraining strap assembly 108 comprised of straps 110 and 112 is secured to seat member 12 adjacent the forward end 26 thereof.

Figure 4:
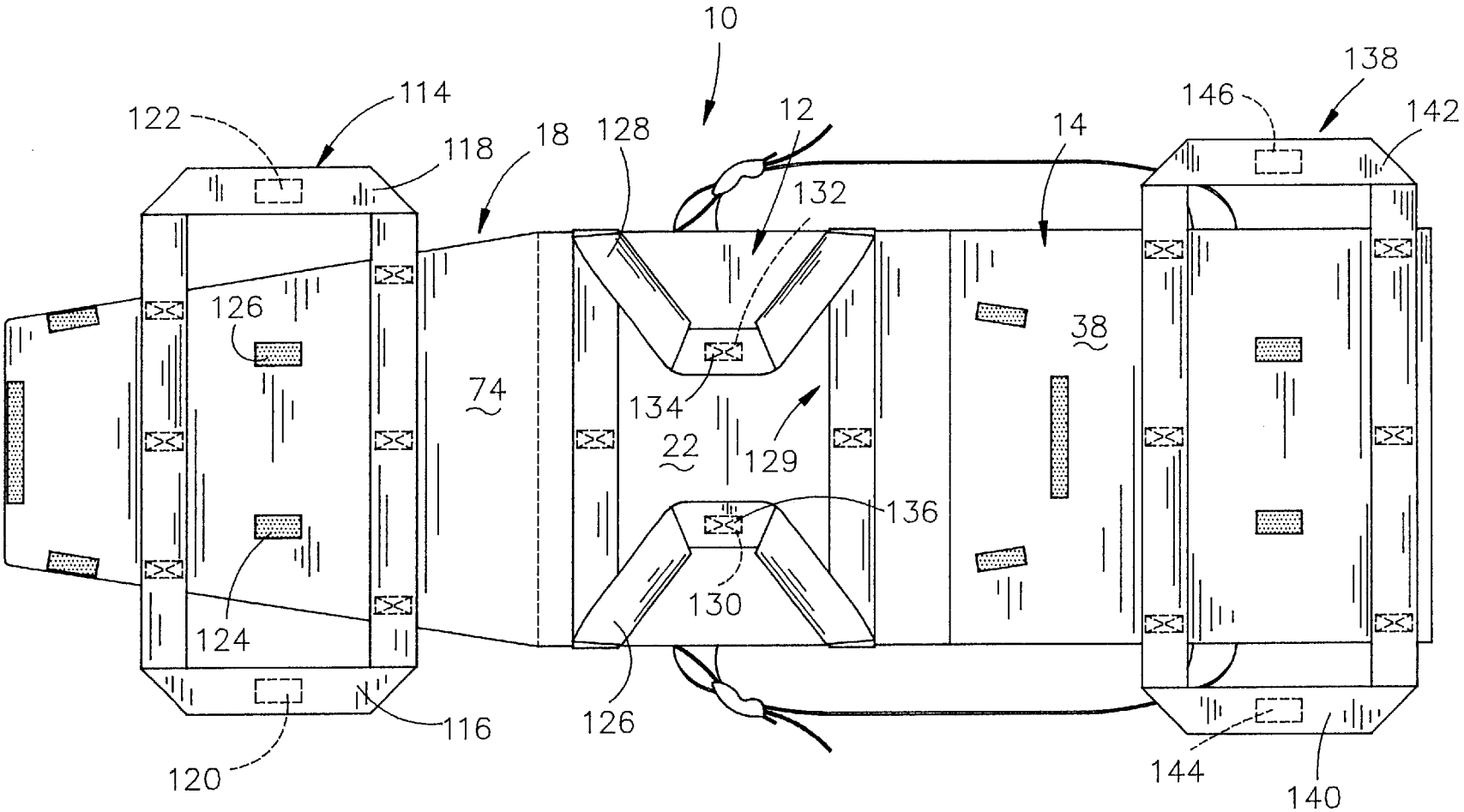
FIG. 4 is a back view of the device of FIG. 3.

A carrying strap 114 is secured to the bottom surface 74 of the leg supporting member 18, as seen in FIG. 4, to provide a pair of carrying handles 116 and 118 extending outwardly from the sides of the member 18. Carrying handles 116 and 118 have strips 120 and 122 of the looped portions of a hook-and-loop fastener which are adapted to be secured to the hooked portions 124 and 126 mounted on the bottom surface 74 of member 18 to maintain the carrying handles 116 and 118 in a stowed condition.

A carrying strap 124 is secured to the bottom surface 22 of seat member 12, as seen in FIG. 4, to provide a pair of carrying handles 126 and 128 extending outwardly from the sides of seat member 12. Handles 126 and 128 have strips 130 and 132 of the looped portions of a hook-and-loop fastener which are adapted to be secured to the strips 134 and 136, secured to bottom surface 74 of member 12, respectively, which comprise the hooked portions of a hook-and-loop fastener to maintain the carrying handles 126 and 128 in a stowed condition below seat member 12.

A carrying strap 138 is secured to the back surface 38 of back member 14, as seen in FIG. 4, to provide a pair of carrying handles 140 and 142 extending outwardly from the sides of back member 14. Handles 140 and 142 have strips 144 and 146 of the looped portions of a hook-and-loop fastener which are adapted to be secured to the strips 148 and 150, secured to the back surface of back member 14, respectively, which comprise the hooked portions of a hook-and-loop fastener to maintain the carrying handles 140 and 142 in a stowed condition behind back member 14.

Figure 9:
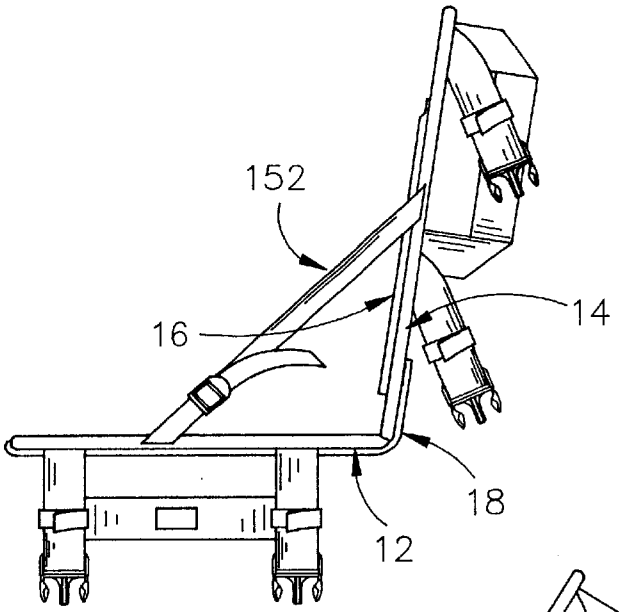
FIG. 9 is a side view of the device.
Figure 10:
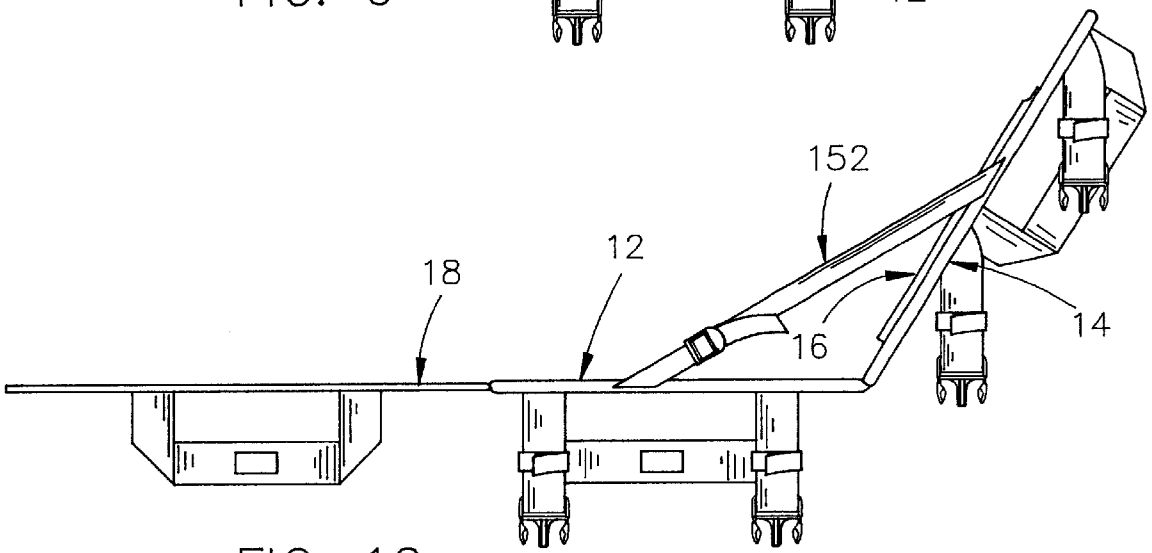
FIG. 10 is a side view similar to FIG. 9 except that the back member has been adjustably moved with respect to the seat member and the leg supporting member has been moved to its leg supporting position.

A length adjustable strap 152 is secured to and extends between one side of back member 14 and one side of seat member 12. Similarly, an adjustable strap 154 is secured to the other side of back member 14 and seat member 12 and extends therebetween. The adjustable straps 152 and 154 permit the back member 14 to be angularly adjusted with respect to seat member 12. When the straps 152 and 154 are loosened, back member 14 may be disposed approximately parallel to sheet member 12. FIGS. 9 and 10 illustrate the manner in which the angular relationship of back member 14 may be changed with respect to seat member 12 so that the patient being transported thereon may be positioned in the most comfortable position.

Figure 8:
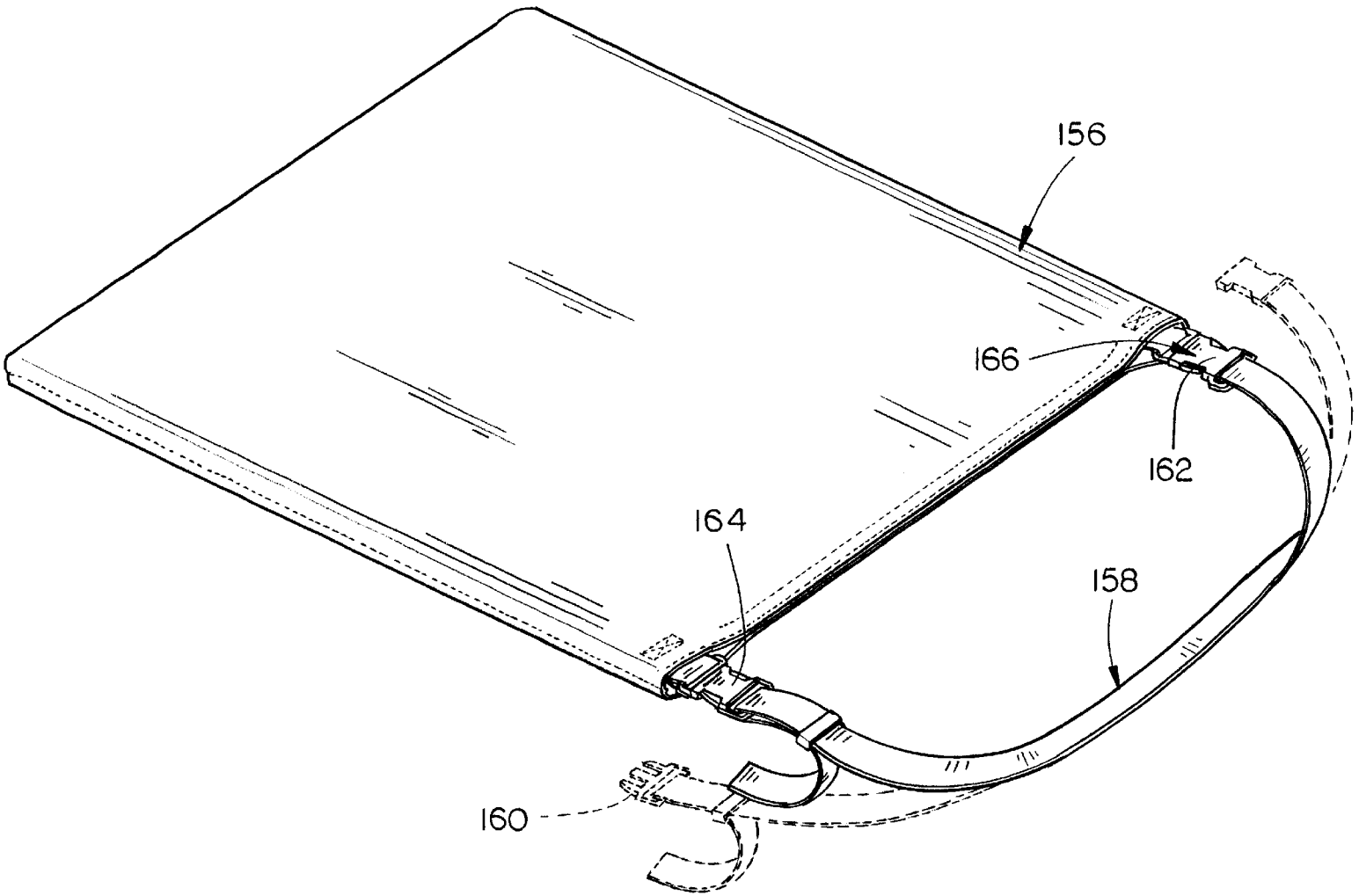
FIG. 8 is a perspective view illustrating the device positioned in a carrying bag.

In FIG. 8, a carrying bag or storage bag is illustrated and is generally referred to by the reference numeral 156. The carrying bag 156 is adapted to receive the device 10 therein when the device is in its completely folded storage position. A length adjustable strap having a male connector 160 at one end thereof and a female 162 at the other end thereof is selectively connected to connectors 164 and 166 which are secured to the bag 156 to provide a convenient means of carrying the bag 156. The carrying strap 158 also performs an additional function in that it may be removed from the bag 156 and looped around the carrying straps 118, as seen in FIG. 1, to assist in carrying the patient.

Figure 7:
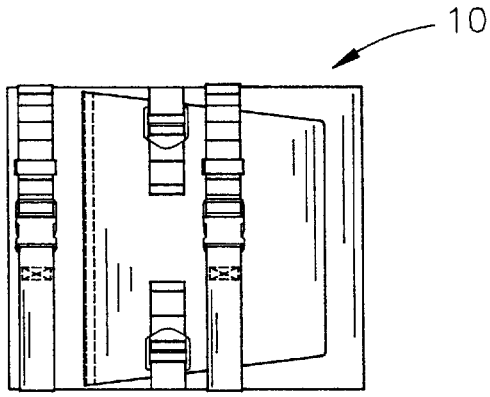
FIG. 7 is a view similar to FIGS. 5 and 6 except that the device has been folded for storage.

In operation, the device 10 is normally stowed folded in a flat position and placed within the carrying bag, as seen in FIG. 8. FIG. 7 illustrates the device in its completely folded position. In the folded position of FIG. 7, the carrying handles 116 and 118 are folded beneath leg supporting member 18 and maintained in that position by the hook-and-loop fasteners, as previously described. Similarly the carrying straps 126 and 128 are folded to the stowed position, as illustrated in FIG. 4. The carrying handles 140 and 142 are also folded inwardly so as to be positioned adjacent the back surface of back member 14 and maintained in that position by the hook-and-loop fasteners, as previously described. The leg supporting member 18 is also folded so as to be positioned beneath the bottom of seat member 12 and behind the seat member 14, as illustrated in FIG. 6. The hook-and-loop fasteners previously described maintain the leg supporting member 18 in the position of FIG. 6. When the device 10 is in the folded position, the head supporting member 16 will be in its folded position with that folded position being illustrated by broken lines in FIG. 2. When in the folded position, the device 10 will have the front surface of back member 14 positioned adjacent the top surface of seat member 12. One or more of the restraining straps may be extended around the folded seat and back members to maintain the device in the folded position.

When it is necessary to transport a patient, the device 10 is removed from the carrying bag 156. If the patient is to be transferred in a sitting position, the adjustable straps 152 and 154 are length adjusted so that the back member 14 will extend upwardly from seat member 12. If it is desired that the patient's legs hang downwardly from the seat member 12, the leg supporting member will be left in the position illustrated in FIG. 9. If it is desired to support the legs of the patient in a horizontal patient when the patient is seated on the device, the leg supporting member 18 is moved from the position of FIG. 9 to the position of FIG. 10. The carrying straps 114, 124 and 138 may be moved from their stowed position to their operative position to provide carrying handles at opposite sides of the device to enable the patient to be easily carried.

If it is desired to transport the patient in a supine position, the length adjustable straps 152 and 154 are loosened so that the back member 14 may be hingedly moved with respect to seat member 12 so that back member 14 is generally parallel to seat member 12. Head supporting member 16 is then moved from the dotted line position of FIG. 2 to the solid line position of FIG. 2 so that head supporting member 16 extends beyond the upper end 42 of back member 14, as illustrated in FIG. 2. The plastic plate inside the head supporting member 16 provides the necessary rigidity for supporting the patient's head. Although the plastic plates in the head supporting member 16, seat member 12, and back member 14 are generally rigid, they do bend somewhat to cradle the patient's body therein. The plastic plates or sheet members within sheet member 12, back member 14, and head supporting member 16 are removable so that the device may be cleaned and sanitized.

Thus it can be seen that a novel patient transport device has been provided which enables the patient to be transported in either a supine position or in a sitting position. Further, the versatility of the device enables the patient to be transported without physically grasping the patient during the transporting procedure. It has been found that the low profile nature of the device, when in the supine transporting position, enables the patient to be easily positioned on the device. Assuming that the patient is lying on a floor or the like, the device is positioned alongside the patient and slipped beneath the patient with a minimum of patient contact.

Thus it can be seen that the invention accomplishes at least all of its stated objectives.

I claim:

1. A patient transport device, comprising:

a seat member having a top surface, a bottom surface, a rear end, a front end, and opposite sides;

a back member having a front surface, a back surface, a lower end, an upper end, and opposite sides;

said lower end of said back member being hingedly connected to said back end of said seat member;

a first length adjustable strap secured to and extending between one side of said seat member to one side of said back member;

a second length adjustable strap secured to and extending between the other side of said seat member to the other side of said back member;

a first carrying strap secured to said seat member including a first carrying handle extending from one side of said seat member and a second carrying handle extending from the other side of said seat member;

a second carrying strap secured to said back member including a first carrying handle extending from one side of said back member and a second carrying handle extending from the other side of said back member;

said carrying handles of said first and second carrying straps being movable between a carrying position and a stowed position;

said first and second length adjustable straps being length adjustable for adjusting the angular relationship of said back member with respect to said seat member.

2. The device of claim 1 wherein said first and second carrying handles of said first carrying strap are positioned adjacent said bottom surface of said seat member when in their said stowed position.

3. The device of claim 1 further including means for maintaining said first and second carrier handles of said first and second carrying straps in their said stowed position.

4. The device of claim 1 wherein said first and second carrying handles of said second carrying strap are positioned adjacent said back surface of said back member when in their stowed position.

5. A patient transport device, comprising:

a seat member having a top surface, a bottom surface, a rear end, a front end, and opposite sides;

a back member having a front surface, a back surface, a lower end, an upper end, opposite sides, and a pair of spaced-apart restraining straps secured thereto;

said lower end of said back member being hingedly connected to said back end of said seat member;

a first length adjustable strap secured to and extending between one side of said seat member to one side of said back member;

a second length adjustable strap secured to and extending between the other side of said seat member to the other side of said back member;

a first carrying strap secured to said seat member including a first carrying handle extending from one side of said seat member and a second carrying handle extending from the other side of said seat member;

a second carrying strap secured to said back member including a first carrying handle extending from one side of said back member and a second carrying handle extending from the other side of said back member;

said first and second length adjustable straps being length adjustable for adjusting the angular relationship of said back member with respect to said seat member.

6. A patient transport device, comprising:

a seat member having a top surface, a bottom surface, a rear end, a front end, opposite sides, and a pair of spaced-apart restraining straps secured thereto;

a back member having a front surface, a back surface, a lower end, an upper end, and opposite sides;

said lower end of said back member being hingedly connected to said back end of said seat member;

a first length adjustable strap secured to and extending between one side of said seat member to one side of said back member;

a second length adjustable strap secured to and extending between the other side of said seat member to the other side of said back member;

a first carrying strap secured to said seat member including a first carrying handle extending from one side of said seat member and a second carrying handle extending from the other side of said seat member;

a second carrying strap secured to said back member including a first carrying handle extending from one side of said back member and a second carrying handle extending from the other side of said back member;

said first and second length adjustable straps being length adjustable for adjusting the angular relationship of said back member with respect to said seat member.

7. A patient transport device, comprising:

a seat member having a top surface, a bottom surface, a rear end, a front end, opposite sides, and a semi-rigid sheet member removably mounted therein;

a back member having a front surface, a back surface, a lower end, an upper end, and opposite sides;

said lower end of said back member being hingedly connected to said back end of said seat member;

a first length adjustable strap secured to and extending between one side of said seat member to one side of said back member;

a second length adjustable strap secured to and extending between the other side of said seat member to the other side of said back member;

a first carrying strap secured to said seat member including a first carrying handle extending from one side of said seat member and a second carrying handle extending from the other side of said seat member;

a second carrying strap secured to said back member including a first carrying handle extending from one side of said back member and a second carrying handle extending from the other side of said back member;

said first and second length adjustable straps being length adjustable for adjusting the angular relationship of said back member with respect to said seat member.

8. A patient transport device, comprising:

a seat member having a top surface, a bottom surface, a rear end, a front end, opposite sides;

a back member having a front surface, a back surface, a lower end, an upper end, opposite sides, and a semi-rigid sheet member removably mounted therein;

said lower end of said back member being hingedly connected to said back end of said seat member;

a first length adjustable strap secured to and extending between one side of said seat member to one side of said back member;

a second length adjustable strap secured to and extending between the other side of said seat member to the other side of said back member;

a first carrying strap secured to said seat member including a first carrying handle extending from one side of said seat member and a second carrying handle extending from the other side of said seat member;

a second carrying strap secured to said back member including a first carrying handle extending from one side of said back member and a second carrying handle extending from the other side of said back member;

said first and second length adjustable straps being length adjustable for adjusting the angular relationship of said back member with respect to said seat member.

9. A patient transport device, comprising:

a seat member having a top surface, a bottom surface, a rear end, a front end, and opposite sides;

a back member having a front surface, a back surface, a lower end, an upper end, and opposite sides;

a head supporting member having a semi-rigid sheet member removably mounted therein; said head supporting member being hingedly secured to said front surface of said back member below said upper end thereof;

said lower end of said back member being hingedly connected to said back end of said seat member;

a first length adjustable strap secured to and extending between one side of said seat member to one side of said back member;

a second length adjustable strap secured to and extending between the other side of said seat member to the other side of said back member;

a first carrying strap secured to said seat member including a first carrying handle extending from one side of said seat member and a second carrying handle extending from the other side of said seat member;

a second carrying strap secured to said back member including a first carrying handle extending from one side of said back member and a second carrying handle extending from the other side of said back member;

said first and second length adjustable straps being length adjustable for adjusting the angular relationship of said back member with respect to said seat member.

* * * * *